United States Patent [19]

Arnold

[11] Patent Number: 4,868,948

[45] Date of Patent: Sep. 26, 1989

[54] VACUUM REFUSE COLLECTOR

[75] Inventor: William T. Arnold, Sutton West, Canada

[73] Assignee: W. T. Arnold Research & Development Inc., Ontario, Canada

[21] Appl. No.: 198,617

[22] Filed: May 19, 1988

Related U.S. Application Data

[63] Continuation of Ser. No. 937,302, Dec. 3, 1986, abandoned.

[51] Int. Cl.[4] ..... A47L 9/00

[52] U.S. Cl. ..... 15/340.1; 15/352; 55/302

[58] Field of Search ..... 15/340.1, 352; 220/403, 220/404; 55/266, 288, 303, 337, 419

[56] References Cited

U.S. PATENT DOCUMENTS

| | | | |
|---|---|---|---|
| 1,784,339 | 12/1930 | Clasen et al. | 55/288 |
| 3,710,412 | 1/1973 | Hollowell | 15/340 |
| 3,778,864 | 12/1973 | Scherer | 15/352 |
| 4,366,594 | 1/1983 | Hyams | 15/340 |
| 4,635,814 | 1/1987 | Jones | 220/403 |
| 4,663,799 | 5/1987 | Kiyooka | 15/330 |

FOREIGN PATENT DOCUMENTS

| | | | |
|---|---|---|---|
| 0114114 | 7/1984 | European Pat. Off. | 15/330 |

*Primary Examiner*—Chris K. Moore
*Attorney, Agent, or Firm*—Fetherstonhaugh & Co.

[57] ABSTRACT

This invention relates to a vacuum refuse collector comprising: a body; a refuse container mounted on the body having a refuse chamber; a filter in the refuse chamber of the refuse container dividing the refuse chamber into a refuse side and a non-refuse side; a flexible refuse tube communicating with the refuse chamber on the refuse side of the filter; an atmosphere port; an air velocity increasing means; duct means forming a first air path from the non-refuse side of the refuse chamber to the inlet of the air velocity increasing means, through the air velocity increasing means and then to atmosphere and a second air path from the atmosphere port to the inlet of the air velocity increasing means through the air velocity increasing means and to the non-refuse side of the refuse chamber; and control means for controlling the differential of air velocity in the first path and the second path to control the air velocity in the pick up tube.

16 Claims, 5 Drawing Sheets

VACUUM REFUSE COLLECTOR

This application is a continuation, of application Ser. No. 937,302, filed Dec. 3,19 and now abandoned.

This invention relates to a vacuum system mountable in a vehicle and used to pick up refuse both out of doors and indoors.

Vacuum systems mountable on vehicles have been known and used for some time. When mounted to the vehicle they permit the operator to drive over the area to be cleaned and pick up the refuse using suction through a pick-up tube.

These vacuum systems have, in the past been plagued by problems during use.

One of the main problems has been the difficulty of unclogging the system after it has become clogged. When a piece of refuse becomes clogged in the vacuum system, it has been the practice to turn the vacuum system off, disassemble the system at either the collecting bin or the pick-up tube and remove the clogging piece by hand. This process of unclogging is time consuming and slows the clean-up process significantly.

A further problem is that there has not been a satisfactory adjustment means to easily adjust the power of the suction in the pick-up tube without awkward manual adjustment by the operator. An easily adjustable suction power means would permit, for example, the operator to lessen the suction when he is vacuuming refuse from a flower bed so as to not damage the flowers without slowing down or temporarily stopping to make that adjustment.

A further problem with vacuum systems mountable to vehicles is that the pick-up tube has not been easily manipulatable about the vehicle. In use, the operator has to drive the vehicle while directing the pick-up tube and, in the past, these actions have been difficult to co-ordinate because the tube has not been easily directable. The vehicle tended to be too wide at the front for the operator to reach to both sides from one seating position and could not be so manufactured. There is a need for a vehicle and pick-up tube design that can be more easily directed by the operator.

This invention provides a vacuum system mountable to a vehicle that permits the operator to unclog the pick-up tube or the collecting bin without disassembly of the system.

This invention also provides a vacuum system with an easily adjustable suction means that permits the operator to vary the power of the suction in the pick-up tube to suit the area that he is vacuuming.

This invention also provides a vacuum system having an easily manipulatable pick-up tube.

According to one aspect of this invention, a vacuum refuse collector comprises: a body; a refuse container mounted on the body having a refuse chamber; a filter in the refuse chamber of the refuse container dividing the refuse chamber into a refuse side and a non-refuse side; a flexible refuse tube communicating with the refuse chamber on the refuse side of the filter; an atmosphere port; an air velocity increasing means; duct means forming a first air path from the non-refuse side of the refuse chamber to the inlet of the air velocity increasing means, through the air velocity increasing means and then to atmosphere and a second air path from the atmosphere port to the inlet of the air velocity increasing means through the air velocity increasing means and to the non-refuse side of said refuse chamber; and control mean for controlling the differential of air velocity in the first path and the second path to control the air velocity in the pick-up tube.

The invention will be fully understood after reading the following description in conjunction with the drawings in which.

Figures 1, 2:
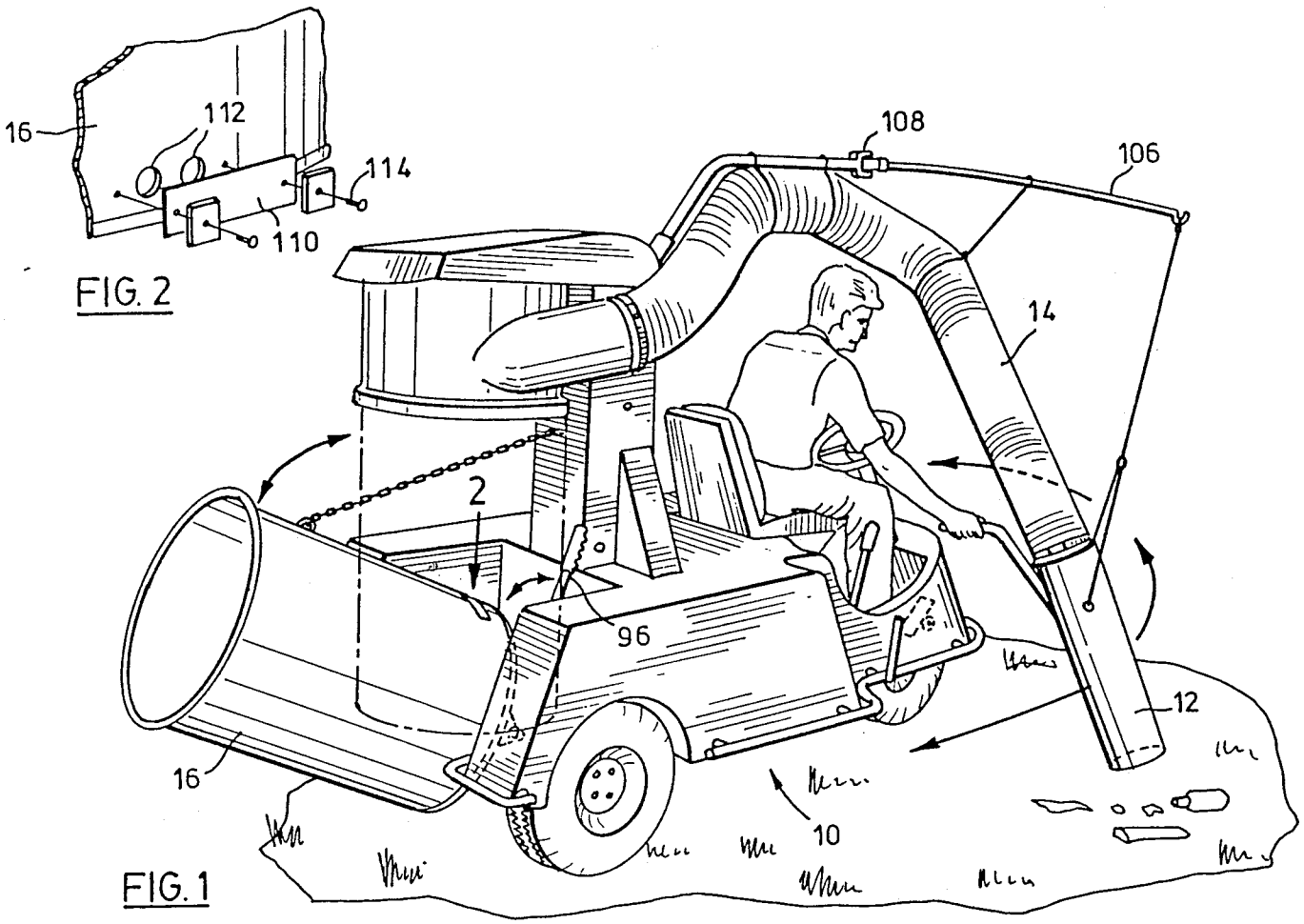
FIG. 1 is an illustration of a vehicle with a vacuum system made in accordance with present invention installed thereon.
FIG. 2 is an illustration of the vent means used to exhaust air from the collecting bin of the vacuum system.

Referring to the drawings, FIG. 1 shows a vacuum system mounted on a three wheeled vehicle 10 driven by an operator. The operator drives the vehicle over the area to be vacuumed and directs hand controlled nozzle 12 of the pick-up tube 14 at the refuse. The vacuum system provides suction through the pick-up tube to draw refuse into the pick-up tube and deposited it in the collecting bin 16 of the vacuum system.

Figure 5:
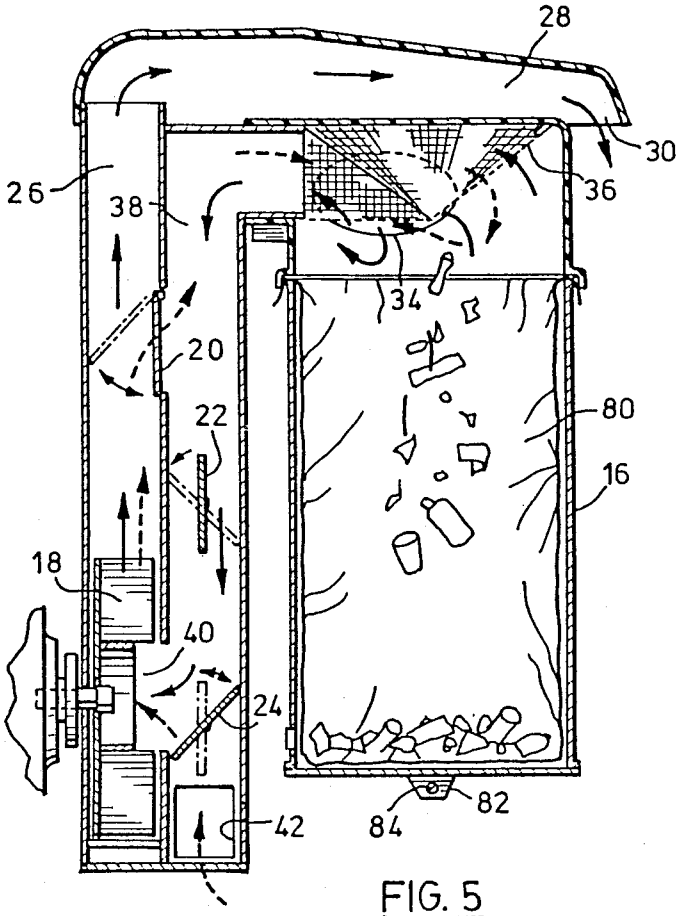
FIG. 5 is an illustration of the path of travel of the air during the vacuuming process to create suction and deposit refuse in the collecting bin.
Figure 8:
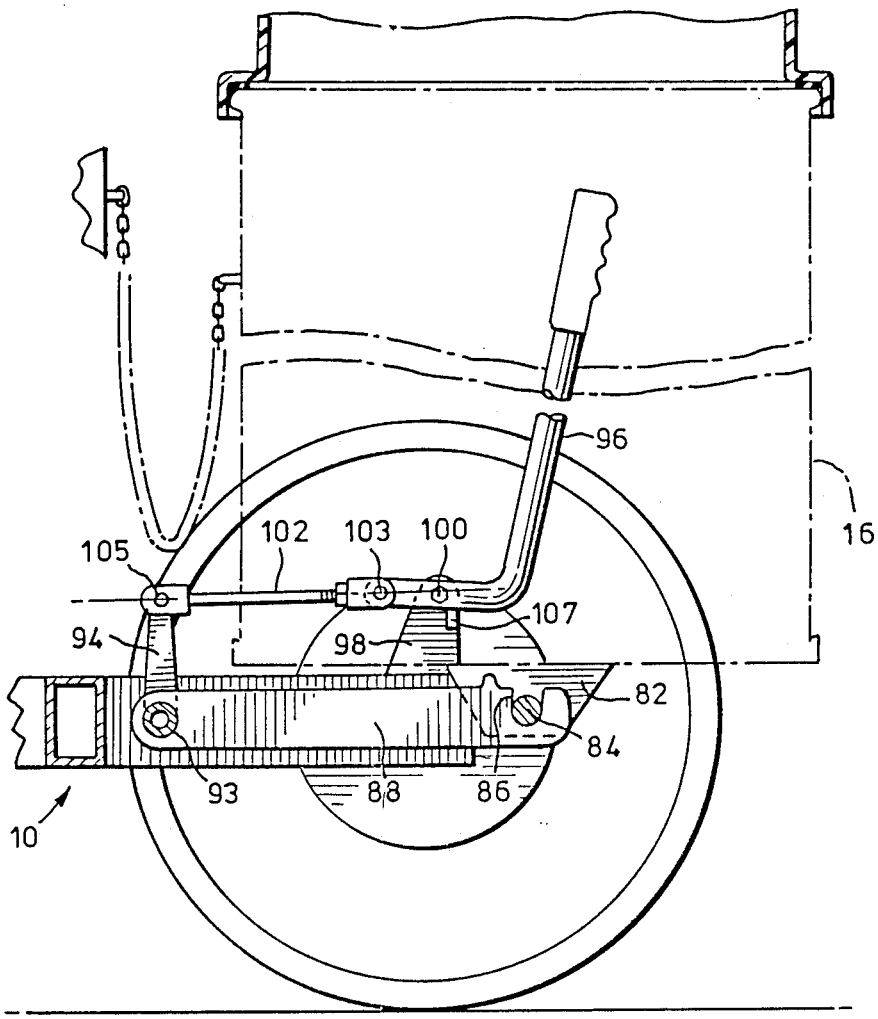
FIG. 8 is an illustration of the mounting of the collecting bin in the vehicle.

In operation, the collecting bin 16 is mounted vertically as illustrated in broken lines in FIG. 1 and as in FIGS. 5 and 8.

The vacuum system includes a motor-driven fan 18 that causes the air in the pick-up tube to move at a velocity sufficient to create suitable vacuum to achieve the necessary power to pick up refuse as required. A velocity of about 150 miles per hour in an 8 inch diameter pick-up tube gives ample pick-up force. If the device is to used for sweeping, a reduction of tube size to six inches for the same motor would increase velocity and give higher vacuum. Motor speed also increases vacuum. These are well understood and adjustable in the art. As will be explained this velocity can be decreased down to zero and reversed in direction with this invention.

Referring to FIG. 5, which shows the air path circuit, two different conditions achieving two different directions of air flow in the pick-up tube are illustrated. The first direction shown by solid line arrows, results when the vacuum system is set up and working with the baffles 20, 22 and 24 as shown in solid lines and results in the creation of maximum vacuum suction at the open end of the nozzle 12 of the pick-up tube. The second direction shown by broken line arrows, results when the vacuum system is set up and working with the baffles 20, 22 and 24 as shown in the dotted lines, and results in the blowing of air out of the open end of the nozzle 12 of the pick-up tube 14.

In the solid line and solid arrow vacuuming mode of operation, the air is driven upwardly of duct 26 by the motor-driven fan 18. The upwardly driven air travels up the vertical passageway 26 to exhaust passageway 28, and out the exhaust port 30 to atmosphere. In this mode, the upward movement of the air through passageway 26 pulls air from the atmosphere through the open end of the nozzle 12, pick-up tube 14, through port 34 of the pick-up tube to the pick-up bin 16, through the filter 36, through passage 38 past baffles 20, 22, and 24 to the inlet 40 of fan 18.

Thus, air travels in through the pick-up tube 14, into the refuse bin 16, through the fan, upwardly from the fan to the exhaust port and atmosphere. This is the full suction mode of operation that gives maximum vacuum pick-up at the nozzle 12 and is used to pick-up heavy refuse as illustrated in FIGS. 1 and 5. Refuse does not pass through the filter and is deposited in the collection bin 16 as shown in FIG. 5.

There are situations in use when the air passage becomes clogged. For instance, an object becomes clogged in the pick-up tube or a piece of paper covers the filter. Air suction through the pick-up tube is reduced or prevented and vacuum pick-up is ineffective. The object must be removed. This vacuum system provides an easy way of removing the object by reversing the direction of the air travelling through the filter or pick-up tube to dislodge the offending object into the collecting bin or out of the open end of the nozzle of the pick-up tube.

To achieve this reversal of flow one operates the baffles 20, 22 and 24 from the solid line position to the broken line position as illustrated in FIG. 5.

When the fan operates with the baffles in the dotted line positions, air is drawn into the fan from atmosphere through port 42, past open baffle 24 to the fan inlet. Closed baffle 22 prevents it from travelling up passageway 38. From the outlet of the fan the air travels past baffle 20 through the opening between passageways 26 and 38, into passageway 38, through the filter 36, and through the pick-up tube 14 to atmosphere. The velocity of the air is the result of full operation of the fan and it will clear clogging of the filer or clogging of the pick-up tube.

Thus, as the reverse flow air moves through the filter and out the pick-up tube it removes the object that had been blocking the suction either by carrying the object out to atmosphere through the pick-up tube or by pushing the object downwardly into the collecting bin. This is the full blowing mode and it is used to clear the system after it has become clogged either at the filter or within the pick-up tube.

The full vacuum force of the fan 18 is designed to pick-up heavy objects such as bottles, packages, etc. One often encounters situations when this force is too great and would prove destructive. For example, if one wants to remove a piece of paper beside a flower in a flower bed. Full force would pick-up the paper but it would also pick up the flower. This invention permits one to conveniently remove the paper without disturbing the flower by reducing the vacuum force. This is done by operating the foot pedal 62 which will be described later.

Variations of strength of the suction mode and blowing mode are achieved by arranging the positions of the baffles 20, 22 and 24 between their two extreme positions shown in FIG. 5. For instance, assume that the extreme suction mode is in operation and that the baffles are positioned as shown in solid line position of FIG. 5 with the air was travelling in the direction as shown by the solid arrows. Suction or pick-up force is maximum but it can be softened by moving the baffles 20, 22 and 24 slightly toward the dotted line positions. In these positions less than all of the air passing through the fan comes from the pick-up tube with the result that the air velocity in the pick-up tube is reduced. This reduces the pick-up force of the pick-up tube.

The full blowing force is achieved with the baffles in the dotted line position. This can be reduced by tilting them towards their solid line position. There is a cross over position in between where there would be no velocity in the pick-up tube in either direction.

An operator having a means to orient the baffles to any degree between their two extreme positions is able to achieve any degree of suction from zero to full suction and any degree of blowing from zero to full blowing. This device has such an adjustment means.

Figures 3, 4:
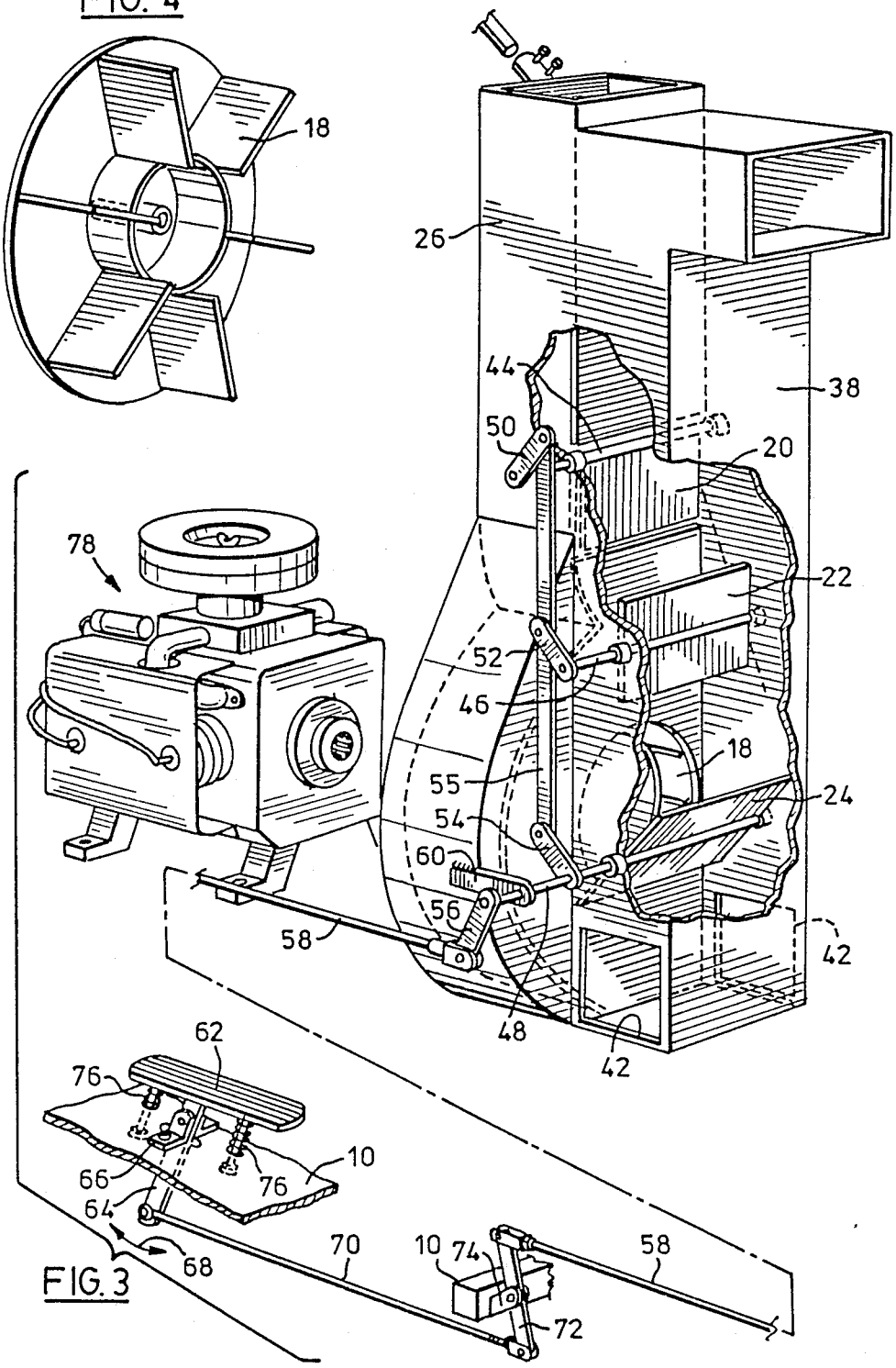
FIG. 3 is an illustration of the vacuum system motor, air passageways and the foot pedal control means for deflecting the air in through the passageways to achieve the several modes of operation of the unit.
FIG. 4 is an illustration of the fan that is driven by the motor to increase the velocity of the air and create the vacuum for picking up refuse and for clearing the vacuum line of obstruction.

FIG. 3 is an illustration of a foot control lever mechanism for operating the baffles 20, 22 and 24 as described. In this illustration the baffles have been illustrated in their respective solid line position of FIG. 5. The baffles 20, 22 and 24 are each mounted on a shaft 44, 46 and 48 that is journalled in the passageways to permit the operation as described.

Each of the shafts 44, 46 and 48 has a crank arm 50, 52 and 54 respectively rigidly secured to its free end. When the baffles assume the solid line position of FIG. 5, the disposition of the cranks is illustrated in FIG. 3. The free end of each of the crank arms 50, 52 and 54 is pivotally connected to an operating lever 55. Shaft 48 has in addition a crank arm 56 secured thereto at its free end. The free end of crank arm 56 pivotally connects with a connecting rod 58. Numeral 60 refers to a mounting bracket for shaft 48 within which the shaft can rotate.

It will be apparent that by reciprocating connecting rod 58 to carry its free end to the right as illustrated in FIG. 3 that the crank arm shafts 44, 46 and 48 will simultaneously rotate to carry the baffle 24 in a counterclockwise direction, baffle 22 in a clockwise direction and baffle 20 in a clockwise direction. In the case of each baffle this is movement from the solid line position of FIG. 5 towards the dotted line position of FIG. 5. It will be apparent that by reciprocating the connecting rod 58 one can move the baffles between the solid line position and the dotted line position at will.

The reciprocating movement of the connecting rod 58 is controlled by a foot pedal 62 which is mounted at the upper end of a lever 64. Lever 64 is pivotally mounted in brackets 66 on the body of the vehicle 10 so that the free end of the lever can be moved in the directions of the arrow 68 by pressure on the foot pedal.

A link 70 pivotally connects the free end of lever 64 with the free end of a lever 72. Lever 72 is mounted for swinging movement in brackets 74 on the body of the vehicle and its free end pivotally connects with the connecting rod 58.

It will be apparent that by swinging the lever 64 within its mounting 66, the free end of the lever 66 swings in an arc 66 and the movement is transmitted through link 70 and link 72 to reciprocate the connecting rod 58 whereby to operate the crank 56 and achieve baffle operation as described.

Springs 76, compressed between the body 10 of the vehicle and the foot pedal 62, maintain the foot pedal in a position that keeps the lever 64 in a position that results in the dampers being close to the solid line position of FIG. 5. As a matter of adjustment it is sometimes desirable to have the springs adjusted so that the normal position is slightly towards the dotted line position of FIG. 5 and the normal suction is something less than maximum. This adjustment gives the operator the opportunity of increasing normal operating vacuum pick up if necessary to pick up a heavy article.

The operator can move the levers by depressing either end of the foot pedal. Thus from the normal position he can increase suction by pressing it somewhat. By the same token he can reduce suction and carry it over to the blow out position to clear the tube by depressing it in the other direction.

The foot pedal 62 is located conveniently for operation by the operator when he sits in the control seat of the vehicle.

In FIG. 3 the portion of the vehicle upon which the bracket 74 and brackets 66 are mounted has been indicated by the numeral 10, the number assigned to the vehicle in specification. Numeral 78 refers to the engine for the vehicle. Fan 18 is operated directly from the drive shaft of the engine of the vehicle. The engine operates at a substantially constant rate of speed and transmits power to the wheels through a standard hydraulic transmission as is well known for this type of vehicle.

The collecting bin 16 has a flexible plastics bag liner 80 so that when the bin is full of refuse, the refuse can be removed from the bin by removing the liner.

In this respect, the refuse bin is mounted on the machine so that it can be moved between the solid line position of FIG. 1 where it is in sealing relation with the machine and the dotted line position of FIG. 1 by operation of lever 96. The dotted line position is the operative position as illustrated in FIG. 5 but the removal position has been illustrated in FIG. 1 in solid lines to illustrate the removal function.

Figure 9:
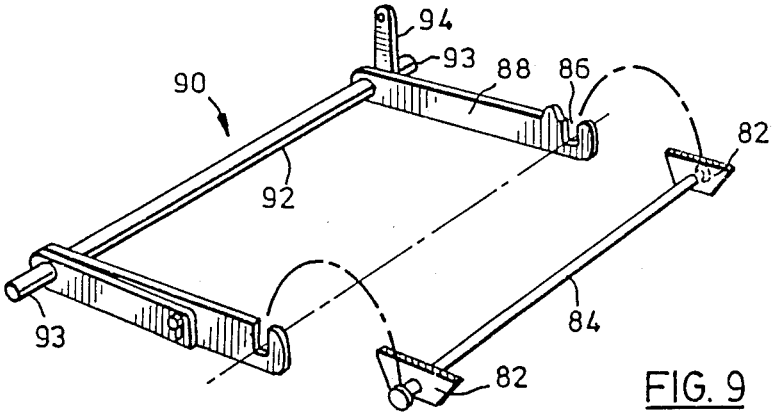
FIG. 9 is an illustration of the bracket used to support the collecting bin on the vehicle.
Figure 10:
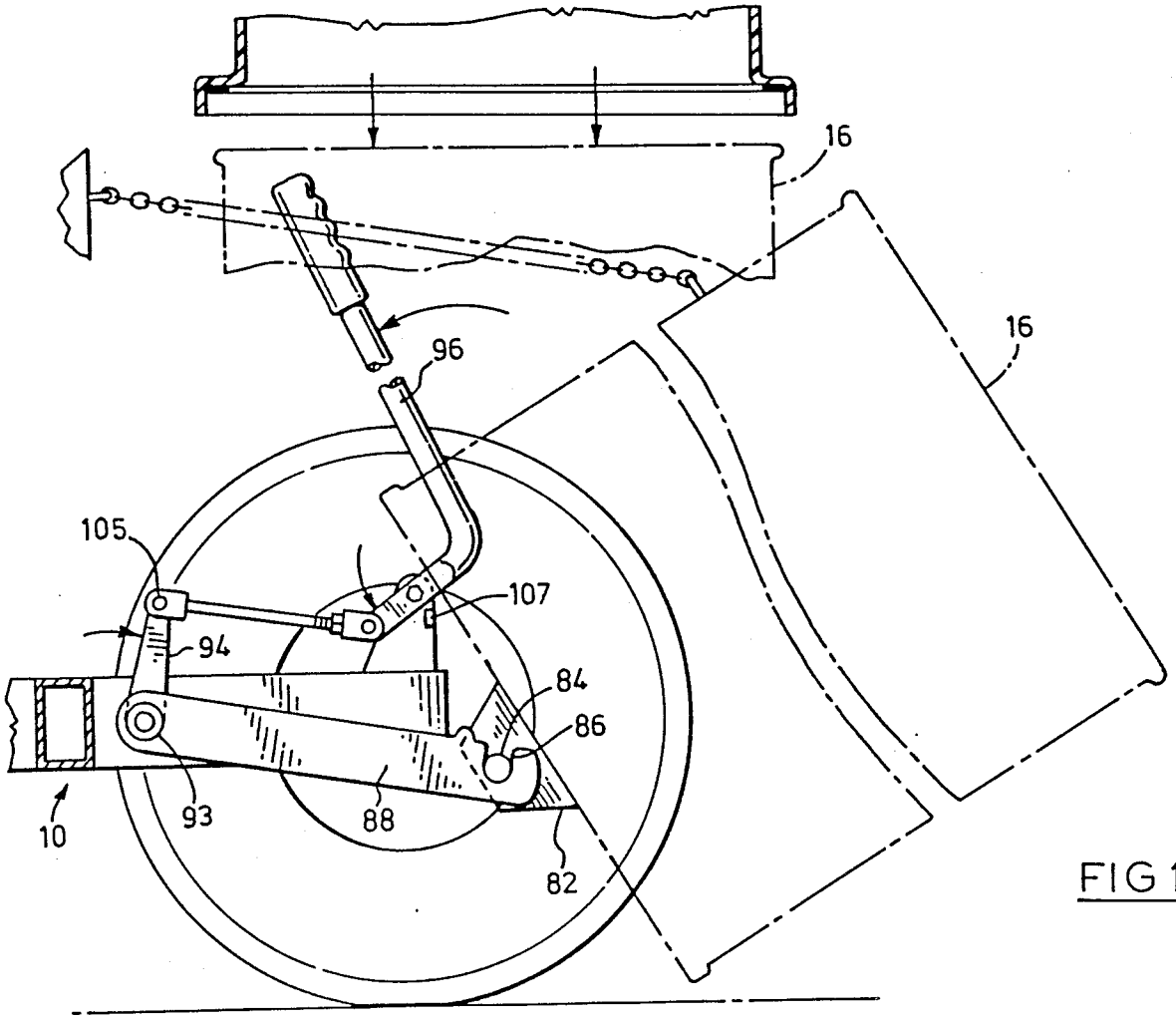
FIG. 10 is an illustration of the mechanism for tilting the collecting bin.

FIGS. 8 and 9 illustrate the mechanics of the mechanism for moving the container between the sealing position and a position from which it can be emptied. The container has a pair of brackets 82, one at each side and welded to its bottom. A shaft 84 extends between the two brackets. The shaft 84 sits in notches 86 of the arms 88 of a mounting assembly generally referred to by the numeral 90 in FIG. 9. The mounting assembly has a shaft 92 that is journalled for pivotal movement in the frame of the vehicle 10 as illustrated in FIG. 8. A crank 94 is rigidly mounted on the end of the shaft 92. It will be apparent that rotation of the crank 94 will cause rotation of the arms 88 of the mounting assembly 90 to move the bin, the shaft 84 of which is journalled in the notches 86 of the arms 88. This allows the bin to drop downwardly from the sealed position.

An operating crank 96 mounted on a bracket 98 which is in turn mounted on the frame of the vehicle 10 can be manually pivoted about its pivotal mounting 100 to carry the free end thereof in an arc. The free end of crank 96 pivotally connects with a link 102. Link 102 pivotally connects at its other end with the crank 94. Thus, the initial dropping of the bin 16 is controlled by manually operable crank 96.

In FIG. 8 the bin 16 is illustrated in the operative position. The weight of the bin is supported in the notches 86 of the arms 88 of the mounting assembly 90 and exerts a force in a clockwise direction on the mounting assembly about its shaft 92 which is pivoted in the frame as at 93. The pivot point 103 between links 102 and crank 96 is above the level of pivotal points 105 and 100. A stop 107 on the frame limits the movement of lever 96 in position illustrated in FIG. 8 when the refuse container is in position as illustrated. Thus the weight of the container urges the handle 96 against a stop when the refuse container is in the operative position and its edges are sealed against the machine.

To release the container one pushes the handle 96 in a counter clockwise direction to overcome the weight of the refuse bin to carry the pivotal point 103 below the line between points 105 and 100. When this is done the weight of the container is free to turn crank 94 in a clockwise direction to permit the platform 90 to initially drop. One then manually swings the bin rearwardly to the position shown in FIG. 1 as limited by the check chain 17.

To reinstall the bin to the position of FIG. 8 one hand tilts the bin to an upright position and then turns lever 96 in a clockwise direction to reinstate the overcentre position of pivotal point 103 and seal the bin in position.

FIG. 2 is a detail of a portion of the bottom of the collecting bin 16. When a bin has been remounted with a fresh plastics insert bag 80, the insert bag probably does not adhere tightly to the sides of the bin.

The plastics bag is relatively impervious to air and in this condition it would likely be sucked against the screen to plug the screen under normal conditions of vacuum operation. One needs to force the bag against the sides of the bin and evacuate the air in the bin that is between the bag and the bin. This done by forcing air into the bag. As air is forced in the bag the air between the bag and the bin is evacuated through holes 112 as resilient gasket 110 yields. When pressure in the bag is released the gasket 110 closes. It is a check valve arrangement.

To achieve air pressure in the bag, one operates the fan to blow air out the nozzle 12 and plugs the end of the nozzle by pressing it against the ground. This forces the air to blow back into the bag and force the bag against the sides of the collecting bin.

Figure 6:
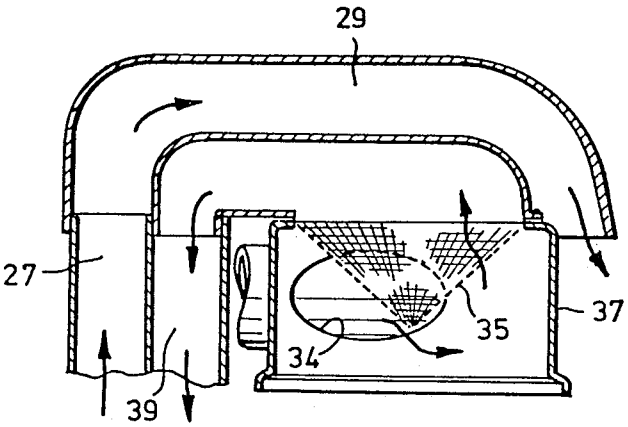
FIG. 6 is an illustration of an alternative head assembly for the vacuum apparatus designed for a different filter construction.
Figure 7:
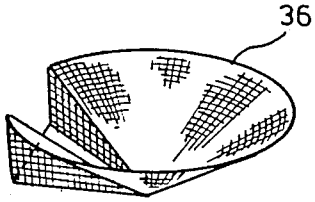
FIG. 7 is an illustration of the filter for FIG. 5 used to prevent refuse from reaching and clogging the fan or motor of the vacuum system.

FIG. 6 shows an alternative construction for the upper portion of the vacuum system showing an alternative type of filter element. The filter of FIG. 7 is formed with an entrance that communicates with the entrance to the passage 38. The filter element 35 of FIG. 6 has a less complicated fit at the upper end of the head 37 of the machine where it communicates with the passage 39 which is the equivalent of the passage 38 of FIG. 5. Otherwise the arrangement is similar. Passage 27 corresponds to passage 26 and passage 29 corresponds to 28 in FIG. 5.

In use, the operator of the vehicle maneuvers the vehicle to the location of refuse as illustrated in FIG. 1. He manually manipulates the location of the rigid nozzle 12 at the end of the flexible hose 14. It will be apparent that by reason of the suspension of the hose and the narrow front end of the vehicle he can direct the nozzle to either side of the vehicle with equal facility. In this connection it will be noted that the nozzle is suspended from a spring suspension boom 106 that can be pivoted around the vehicle with the biforcated bracket 108. The combination of the narrow front width and the swing-able boom greatly increase the flexability of the unit. The ability to move completely around the vehicle and to pick up refuse on both sides is an advantage of the boom suspension of the manually manipulated nozzles.

As indicated the operator picking up heavy refuse such as bottles, newspapers would use substantially full vacuum and the baffles would be close to or at the solid line position illustrated in FIG. 5. If he should require less vacuum he would by manipulation of the foot pedal 62 cut the vacuum in the tube by tilting the levers towards the dotted line position.

If the system should become clogged in any way it is a simple matter to operate the foot pedal to cause the baffles to move to the dotted line illustrated in FIG. 5. This causes the air to blow through the system in the opposite direction and clear the obstruction. Thus it is not necessary to stop the machine in the case of obstruction. From the explanation given above of the means for emptying the can it will be appreciated that emptying the can is merely a matter of operating the handle lever 96 to release the collecting bin from the dotted line position of FIG. 1 and swinging it to the solid line position of FIG. 1 from which the plastics bag can be removed and a new one inserted for refitting to the machine. It is replaced to operating position by operation of handle lever 96.

Embodiments of the invention other than those illustrated will be apparent to those skilled in the art. For example, different ways of achieving the blow back and variations in vacuum pressure are contemplated. Prime requirement is that one have some means for varying the velocity of the air and changing the direction of the air in the pick-up tube.

I claim:

1. A vacuum refuse collector comprising:

a body;

a refuse container mounted on the body, said refuse container having a refuse chamber formed therein;

a filter in the refuse chamber of the refuse container dividing the refuse chamber into a refuse side and a non-refuse side;

a flexible refuse collection tube communicating with the refuse chamber on the refuse side of the refuse chamber;

an air inlet port;

an air velocity increasing means;

duct means forming a first air path from the non-refuse side of the refuse chamber to the inlet of the air velocity increasing means, through the air velocity increasing means and then to atmosphere through an exhaust port and a second air path from the air inlet port to the inlet of the air velocity increasing means through the air velocity increasing means and to the non-refuse side of said refuse chamber; and control means for selectively placing the air velocity increasing means in communication with the first or second air path to selectively draw air through the first air path to create a suction in the refuse collection tube or blowing air through said second path to remove obstructive material from said filter and from said refuse collection tube as required in use.

2. A vacuum refuse collector comprising:

a body;

a refuse container mounted on the body having a refuse chamber;

a filter in the refuse chamber of the refuse container dividing the refuse chamber into a refuse side and a non-refuse side;

a flexible refuse tube communicating with the refuse chamber on the refuse side of the filter;

an atmosphere port;

an air velocity increasing means;

duct means forming a first air path from the non-refuse side of the refuse chamber to the inlet of the air velocity increasing means, through the air velocity increasing means and then to atmosphere and a second air path from the atmosphere port to the inlet of the air velocity increasing means through the air velocity increasing means and to the non-refuse side of said refuse chamber; and control means for controlling the differential of air velocity in the first path and the second path to control the air velocity in the pick up tube, said control means comprising a first damper between the first air path and the second air path located with respect to the first air path upstream of the air velocity increasing means, a second damper in the first path downstream of the first damper and upstream of the air velocity increasing means, and a third damper in the second path upstream of the atmosphere port and downstream of the air velocity increasing device.

3. A vacuum refuse collector as claimed in claim 1 in which said control means is manually operable from a single operating lever.

4. A vacuum refuse collector as claimed in claim 3 in which said control means includes a first damper between the first air path and the second air path located with respect to the first path upstream of the air velocity increasing means, a second damper in the first path downstream of the first damper and upstream of the air velocity increasing means, and a third damper in the second path upstream of the atmosphere port and downstream of the air velocity increasing device.

5. A vacuum refuse collector as claimed in claim 2 or claim 4 in which said first damper, said second damper, said third damper and said single operating lever are link interconnected for operation by said single operating lever, said dampers being operable from normal positions wherein said first damper is closed, said second damper is open and said third damper is closed by operation of said lever.

6. A vacuum refuse collector as claimed in claim 2 or claim 4 wherein said dampers are operable by said single operating lever from normal positions wherein said first damper is closed, said second damper is open and said third damper is closed, operation of said lever.

7. A vacuum refuse collector as claim in claim 3 in which said vacuum refuse collector is mounted on a wheeled vehicle, said flexible refuse tube having a handle that is manually manipulatable from the vehicle, said vehicle having a boom to support the pick up tube, said boom being pivotally mounted on the vehicle to swing in a horizontal arc to support the pick up tube as its open end is moved in a path from one side of the vehicle, around the front of the vehicle to the other side of the vehicle and return, said vehicle having a width at the front that permits an operator to swing said boom in a path as aforesaid from one seat position.

8. A vacuum refuse container as claimed in claim 3 in which said refuse container is adapted to receive a liner, said liner underlying said filter, there being a relief valve in the side of said refuse container for relieving air pressure between a liner and the interior of said refuse container.

9. A vacuum refuse collector as claimed in claim 1 in which said vacuum refuse collector is mounted on a wheeled vehicle, said flexible refuse tube having a handle that is manually manipulatable from the vehicle, said vehicle having a boom to support the pick up tube, said boom being pivotally mounted on the vehicle to swing in a horizontal arc to support the pick up tube as its open end is moved in a path from one side of the vehicle, around the front of the vehicle to the other side of the vehicle and return, said vehicle having a width at the front that permits an operator to swing said boom in a path as aforesaid from one seat position.

10. A vacuum refuse collector as claimed in claim 2 in which said vacuum refuse collector is mounted on a wheeled vehicle, said flexible refuse tube having a handle that is manually manipulatable from the vehicle, said vehicle having a boom to support the pick up tube, said boom being pivotally mounted on the vehicle to swing in a horizontal arc to support the pick up tube as its open end is moved in a path from one side of the vehicle, around the front of the vehicle to the other side of the vehicle and return, said vehicle having a width at the front that permits an operator to swing said boom in a path as aforesaid from one seat position.

11. A vacuum refuse container as claimed in claim 1 in which said refuse container is adapted to receive a liner, said liner underlying said filter, there being a relief valve in the side of said refuse container for relieving air pressure between a liner and the interior of said refuse container.

12. A vacuum refuse container as claimed in claim 2 in which said refuse container is adapted to receive a liner, said liner underlying said filter, there being a relief valve in the side of said refuse container for relieving air pressure between a liner and the interior of said refuse container.

13. A vacuum refuse collector comprising:

a body;

a refuse container mounted on the body having a refuse chamber;

a filter in the refuse chamber of the refuse container dividing the refuse chamber into a refuse side and a non-refuse side;

a flexible refuse tube communicating with the refuse chamber on the refuse side of the filter;

an atmosphere port;

an air velocity increasing means;

duct means forming a first air path from the non-refuse side of the refuse chamber to the inlet of the air velocity increasing means, through the air velocity increasing means and then to atmosphere and a second air path from the atmosphere port to the inlet of the air velocity increasing means through the air velocity increasing means and to the non-refuse side of said refuse chamber; and control means for controlling the differential of air velocity in the first path and the second path to control the air velocity in the pick up tube, said control means comprising a first damper between the first air path and the second air path located with respect to the first air path upstream of the air velocity increasing means, a second damper in the first path downstream of the first damper and upstream of the air velocity increasing means, and a third damper in the second path upstream of the atmosphere port and downstream of the air velocity increasing device.

14. A vacuum refuse collector comprising:

a wheeled motor driven vehicle having front and rear ends, said vehicle having a drivers seat located centrally of said front end, a vacuum refuse collector comprising a refuse container, a flexible refuse tube having one end communication with said refuse container and an open end for receiving trash which is to be drawn through the refuse tube into the refuse container, a manually engageable handle mounted on said refuse tube so as to be accessible to an operator seated on said driver's seat, means for drawing air through said refuse tube into the refuse container;

a boom mounted on said vehicle for supporting said refuse tube, said boom comprising a fixed arm which is mounted on the vehicle and having a distal end which is located directly above the driver's seat and a movable arm which has a proximal end pivotally mounted on the distal end of the fixed arm for movement in a generally horizontal plane about a first axis which is substantially vertically oriented and a distal end which extends outwardly with respect to said front end of said vehicle, means for connecting said distal end of said movable arm to support said refuse tube adjacent the open end thereof, said movable arm being free to swing about said first axis in a horizontal arc by manipulating said handle when seated on said driver's seat to locate the refuse tube as its open end is moved in a horizontal path from one side of the vehicle, around said front end of the vehicle and to the other side of the vehicle.

15. A vacuum refuse collector as claimed in claim 1, wherein said control means is operable to control the differential of air velocity in the first path with respect to the air velocity in the second path to control the air velocity in the flexible refuse collection tube.

16. A vacuum refuse collector comprising:

(a) a road-going vehicle, (b) a refuse container mounted on said vehicle, said refuse container having a refuse chamber formed therein, (c) a filter dividing the refuse chamber into a refuse compartment and a non-refuse compartment, (d) a refuse collection tube having an intake end and a discharge end, the discharge end communicating with said refuse compartment, (e) air circulating means connected to said refuse container remote from said refuse collection tube and communicating with the non-refuse compartment and being operable to selectively withdraw air from or deliver air under pressure to the non-refuse compartment of the refuse chamber, such that when air is withdrawn from the non-refuse compartment it will draw air through the refuse collection tube into the refuse compartment of the refuse chamber, through the filter to the non-refuse compartment and will serve to draw refuse into the refuse compartment of the chamber and when air is delivered under pressure, air will pass through the filter into the refuse side, thereby cleaning the filter and then through the refuse collection tube to unclog the collection tube as required in use.

* * * * *